US007419370B2

(12) United States Patent
Masuda

(10) Patent No.: US 7,419,370 B2
(45) Date of Patent: Sep. 2, 2008

(54) SCROLL COMPRESSOR HAVING A POSITION ADJUSTMENT DEVICE URGING THE MOVABLE SCROLL TOWARDS THE STATIONARY SCROLL BY MOVING A SEAL FORMED BETWEEN A SUPPORT AND THE MOVABLE SCROLL

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/581,349

(22) PCT Filed: Dec. 16, 2004

(86) PCT No.: PCT/JP2004/018836

§ 371 (c)(1),
(2), (4) Date: Jun. 2, 2006

(87) PCT Pub. No.: WO2005/064166

PCT Pub. Date: Jul. 14, 2005

(65) Prior Publication Data

US 2007/0110605 A1 May 17, 2007

(30) Foreign Application Priority Data

Dec. 19, 2003 (JP) ..... 2003-422612

(51) Int. Cl.
*F03C 2/00* (2006.01)
*F03C 4/00* (2006.01)
*F04C 18/00* (2006.01)

(52) U.S. Cl. ..... 418/55.5; 418/55.4; 418/57

(58) Field of Classification Search ..... 418/55.1–55.6, 418/57

See application file for complete search history.

(56) References Cited

U.S. PATENT DOCUMENTS

| | | | | | |
|---|---|---|---|---|---|
| 4,596,520 | A | * | 6/1986 | Arata et al. | 418/55.5 |
| 5,145,345 | A | * | 9/1992 | Barito et al. | 418/55.5 |
| 5,249,941 | A | * | 10/1993 | Shibamoto | 418/55.5 |
| 6,872,063 | B2 | * | 3/2005 | Kimura et al. | 418/55.5 |
| 2002/0039540 | A1 | * | 4/2002 | Kuroki et al. | 418/55.5 |

FOREIGN PATENT DOCUMENTS

| | | | | | |
|---|---|---|---|---|---|
| JP | 58-098687 | A | | 6/1983 | |
| JP | 61-073093 | U | | 5/1986 | |
| JP | 04166690 | A | * | 6/1992 | 418/55.5 |
| JP | 06173864 | A | * | 6/1994 | 418/55.5 |
| JP | 08-334094 | A | | 12/1996 | |

* cited by examiner

*Primary Examiner*—Theresa Trieu
(74) *Attorney, Agent, or Firm*—Global IP Counselors

(57) ABSTRACT

A scroll compressor has a moving scroll and a stationary scroll in contact with each other. A seal ring for defining a back pressure space at a rear side of the moving scroll is provided and its position is adjusted between a sealing position and a leakage position with respect to an end plate of the moving scroll.

5 Claims, 5 Drawing Sheets

SCROLL COMPRESSOR HAVING A POSITION ADJUSTMENT DEVICE URGING THE MOVABLE SCROLL TOWARDS THE STATIONARY SCROLL BY MOVING A SEAL FORMED BETWEEN A SUPPORT AND THE MOVABLE SCROLL

CROSS-REFERENCE TO RELATED APPLICATIONS

This U.S. National stage application claims priority under 35 U.S.C. §119(a) to Japanese Patent Application No. 2003-422612, filed in Japan on Dec. 19, 2003, the entire contents of which are hereby incorporated herein by reference.

TECHNICAL FIELD

The present invention relates to a scroll compressor, particularly to a scroll compressor in which the position of one of a first scroll and a second scroll is adjustable along the axial direction.

BACKGROUND ART

In general, a scroll compressor includes in a casing a compressor mechanism including a first scroll having an end plate and a spiral wrap formed thereon and a second scroll having an end plate and a spiral wrap formed thereon and engaging with the first scroll. Usually, the first scroll is a stationary scroll which is prohibited from revolving in the casing and the second scroll is a moving scroll which is driven by a drive shaft to revolve about the drive shaft with a certain turning radius. In the scroll compressor, the moving scroll revolves about the drive shaft to vary the capacity of a compressor chamber defined between the stationary scroll and the moving scroll, thereby compressing gas such as refrigerant.

As an example of the above-described scroll compressor, Japanese Unexamined Patent Publication No. H8-334094 describes a scroll compressor including a position adjustment means for adjusting the position of one of the stationary and moving scrolls along the axial direction of the compressor mechanism. In the scroll compressor, the position adjustment means is configured to change the relative position of the scrolls between a compression position at which the wraps of the scrolls are in sealed contact with each other to define a compressor chamber therebetween and a non-compression position at which the wraps are not in the sealed contact. The scroll compressor is driven with the scrolls always at the compression position to work at 100% capacity. The scroll compressor is also able to work at a capacity less than 100% by intermittently shifting the scrolls to the non-compression position.

In the scroll compressor described in Japanese Unexamined Patent Publication No. H8-334094, an electromagnetic valve is used as the position adjustment means for making either one of a high pressure path and a low pressure path, both of which are connected to a chamber formed at the front side of the stationary or moving scroll, communicate with the chamber, thereby applying high or low pressure to the stationary or moving scroll. The scrolls are pressed against each other when the high pressure is applied, while they are separated when the low pressure is applied. For example, the chamber may be space inside a seal ring which is pressed against the bottom surface of the moving scroll (back pressure space).

SUMMARY OF THE INVENTION

Problem that the Invention is to Solve

If the position adjustment means is achieved by an electromagnetic valve for switching the pressure of a refrigerant between high and low to apply the pressure to the stationary and moving scrolls, big noise occurs as a large amount of high pressure gas flows out of the chamber to the low pressure path when the electromagnetic valve is operated to bring the low pressure path to communicate with the chamber in place of the high pressure path.

The present invention has been achieved in view of the above-described problem. As to the scroll compressor in which the position of one of the first and second scrolls is adjustable along the axial direction, an object of the invention is to prevent the occurrence of noise when the position is adjusted.

Means of Solving the Problem

When high pressure gas is leaked out of the back pressure space (high pressure region) (S3) for bringing a first scroll (21) and a second scroll (22) into press contact with each other, a gap is formed between the scrolls (21, 22) and compression does not occur. Based on the fact, the present invention makes it possible to adjust the position of a seal (18) for defining the back pressure space (S3) at a rear side of the first scroll (21) or the second scroll (22) with respect to an end plate (23 or 25) of the scroll (21 or 22), i.e., between a sealing position and a leakage position.

Specifically, a first aspect of the present invention is directed to a scroll compressor including: a compressor mechanism (20) including a first scroll (21) having an end plate (23) and a spiral wrap (24) formed thereon and a second scroll (22) having an end plate (25) and a spiral wrap (26) formed thereon and engaging with the first scroll (21); a support (16) for supporting the second scroll (22); a seal (18) arranged between the support (16) and the second scroll (22); and a position adjustment means (40) for changing the position of the second scroll (22) along the axial direction of the compressor mechanism (20), wherein the seal (18) hermetically contacts the end plate (25) of the second scroll (22) such that back pressure space (S3) for bringing the first scroll (21) and the second (22) into press contact with each other is defined inside the seal (18) with the scrolls (21, 22) being engaged.

The position adjustment means (40) is configured to change the position of the seal (18) between a sealing position at which the seal (18) hermetically contacts the end plate (25) of the second scroll (22) and a leakage position at which the seal (18) is separated from the end plate (25) of the second scroll (22).

A second aspect of the present invention is directed to a scroll compressor including: a compressor mechanism (20) including a first scroll (21) having an end plate (23) and a spiral wrap (24) formed thereon and a second scroll (22) having an end plate (25) and a spiral wrap (26) formed thereon for engaging with the first scroll (21); a support (17) for supporting the first scroll (21); a seal (18) arranged between the support (17) and the first scroll (21); and a position adjustment means (40) for changing the position of the first scroll (21) along the axial direction of the compressor mechanism (20), wherein the seal (18) hermetically contacts the end plate (23) of the first scroll (21) such that back pressure space (S3) for bringing the first scroll (21) and the second scroll (22) into press contact with each other is defined inside the seal (18) with the scrolls (21, 22) being engaged.

The position adjustment means (40) is configured to change the position of the seal (18) between a sealing position at which the seal (18) hermetically contacts the end plate (23) of the first scroll (21) and a leakage position at which the seal (18) is separated from the end plate (23) of the first scroll (21).

According to a third aspect of the present invention, the first scroll (21) is a stationary scroll prohibited from revolving and the second scroll (22) is a moving scroll capable of moving with respect to the first scroll (21).

According to the first to third aspects of the present invention, when the seal (18) is situated at the sealing position, the pressure of the back pressure space (S3) brings the wraps (24, 26) into press contact with each other in a sealed state to define a compressor chamber (27) between the wraps (24, 26). This is referred to as a compression position. When the seal (18) is situated at the leakage position, the wraps (24, 26) are separated to be in a non-sealed state. This is referred to as a non-compression position.

According to the first aspect of the present invention, the scrolls (21, 22) are always kept at the compression position such that the compressor is operated at 100% capacity. If the scrolls (21, 22) are intermittently shifted to the non-compression position, the compressor is operated at a capacity less than 100%. According to the above-described aspects of the present invention, the scrolls (21, 22) are easily controlled between the compression position and the non-compression position by changing the position of the seal (18) between the sealing position and the leakage position using the position adjustment means (40).

Specifically, according to the first aspect of the present invention, when the seal (18) is situated at the sealing position, the seal (18) hermetically contacts the end plate (25) of the second scroll (22) to define the back pressure space (S3). According to the pressure of the back pressure space (S3), the first scroll (21) and the second scroll (22) are kept in press contact with each other. Therefore, the compression is carried out in this state. When the seal (18) is situated at the leakage position, a gap is formed between the end plate (25) of the second scroll (22) and the seal (18), and therefore the second scroll (22) is not pressed against the first scroll (21). In this state, the compression is not carried out.

According to the second aspect of the present invention, when the seal (18) is situated at the sealing position, the seal (18) hermetically contacts the end plate (23) of the first scroll (21) to define the back pressure space (S3). According to the pressure of the back pressure space (S3), the first scroll (21) and the second scroll (22) are kept in press contact with each other. Therefore, the compression is carried out in this state. When the seal (18) is situated at the leakage position, a gap is formed between the end plate (23) of the first scroll (21) and the seal (18), and therefore the first scroll (21) is not pressed against the second scroll (22). In this state, the compression is not carried out.

According to the first to third aspects of the present invention, if the compression mechanism (20) is adapted to suck liquid refrigerant or oil, the wraps (24, 26) of the scrolls (21, 22) are situated at the non-compression position to avoid liquid compression.

According to a fourth aspect of the present invention related to the first, second or third aspect of the present invention, the end plate (23 or 25) of the first scroll (21) or the second scroll (22) is provided with a back pressure introduction path (23*a* or 25*a*) for making the back pressure space (S3) communicate with part of a compressor chamber (27) defined between the first scroll (21) and the second scroll (22), the part being closer to the center than the periphery of the compressor chamber (27).

According to the fourth aspect of the present invention, when the seal (18) is situated at the sealing position where the seal (18) comes in contact with the end plate (25) of the second scroll (22), the back pressure space (S3) is kept at the same pressure as the pressure in part of the compressor chamber (27) which is closer to the center than the periphery thereof and applied with middle pressure (MP) or high pressure (HP). Therefore, the second scroll (22) is kept pressed against the first scroll (21) by the gas pressure. On the other hand, when the seal (18) is situated at the leakage position where the seal (18) is separated from the end plate (25), the back pressure space (S3) communicates with space surrounding the seal (18), whereby the pressure in the back pressure space (S3) becomes low (LP). Accordingly, the second scroll (22) is separated from the first scroll (21) and the compression is not carried out. At this time, the space between the scrolls (21, 22) (compressor chamber (27)) loses the compression function because the peripheral part and the center part of the space communicate with each other.

According to a fifth aspect of the present invention related to the first, second, third or fourth aspect of the present invention, the support (16 or 17) includes a support recess (16*a* or 17*a*) for supporting the seal (18) such that the seal (18) moves toward or away from the support (16 or 17) and the position adjustment means (40) includes a high pressure communication path (41) for making a rear end part of the support recess (16*a* or 17*a*) communicate with a high pressure region (S2), a low pressure communication path (42) for making a rear end part of the support recess (16*a* or 17*a*) communicate with a low pressure region (14) and a switching mechanism (43) for switching the communication between the support recess (16*a* or 17*a*) and the low pressure communication path (42).

According to the fifth aspect of the present invention, when the rear end part of the support recess (16*a* or 17*a*) communicates with the high pressure region (S2) via the high pressure communication path (41), the seal (18) is pressed against the end plate (23 or 25) of the first scroll (21) or the second scroll (22) under high pressure, thereby defining the back pressure space (S3) inside the seal (18). Then, when high pressure gas is introduced into the back pressure space (S3), the first scroll (21) and the second scroll (22) are brought into press contact with each other to perform the compression. On the other hand, if the rear end part of the support recess (16*a* or 17*a*) communicates with the low pressure region (14) via the low pressure communication path (42), the high pressure gas in the rear end part of the support recess (16*a* or 17*a*) flows into the low pressure region (14), thereby reducing the pressure in the support recess (16*a* or 17*a*). As a result, the force pressing the seal (18) against the first scroll,(21) or the second scroll (22) disappears to form a gap between the end plate (23 or 25) and the seal (18). In this state, the compression is not carried out.

According to a sixth aspect of the present invention related to the fifth aspect of the present invention, the high pressure communication path (41) is provided with a restrictor (44) and the low pressure communication path (42) is provided with an on-off valve (43) as the switching mechanism.

According to the sixth aspect of the present invention, when the on-off valve (43) of the low pressure communication path (42) is closed, high pressure gas in the high pressure region (S2) is introduced into the rear end part of the support recess (16*a* or 17*a*) via the restrictor (44), thereby raising the pressure in the support recess (16*a* or 17*a*). As a result, the seal (18) is pressed against the end plate (23 or 25) of the first scroll (21) or the second scroll (22).

When the on-off valve (43) of the low pressure compression path (42) is opened, the high pressure gas in the support recess (16*a* or 17*a*) flows into the low pressure region (14), thereby reducing the pressure in the support recess (16*a* or 17*a*). As a result, the seal (18) is separated from the end plate (23 or 25). In this state, only a small amount of the high pressure gas flows into the support recess (16*a* or 17*a*) via the high pressure communication path (41) because the restrictor (44) of the high pressure communication path (41) functions as a resistor. The small amount of the high pressure gas also flows into the low pressure region (14) via the low pressure communication path (42).

Effect of the Invention

According to the first aspect of the present invention, the position adjustment means (40) adjusts the position of the seal (18) between the sealing position at which the seal (18) hermetically contacts the end plate (25) of the second scroll (22) and the leakage position at which the seal (18) is separated from the end plate (25) of the second scroll (22), thereby moving the second scroll (22) toward the first scroll (21) along the axial direction. If the scrolls (21, 22) are always kept at the compression position, the compressor is operated at 100% capacity. Further, if the scrolls (21, 22) are intermittently shifted to the non-compression position, the compressor is operated at a capacity less than 100%.

The position of the second scroll (22) is changed between the compression position and the non-compression position by merely adjusting the position of the seal (18). Therefore, different from a conventional technique of changing the pressure of the whole gas in a chamber (back pressure space) between high and low to bring the first scroll (21) and the second scroll (22) into press contact with each other, the position of the seal (18), which is a relatively small piece, is changed with use of a small amount of gas. Therefore, the occurrence of noise is reduced.

According to the second aspect of the present invention, the position adjustment means (40) adjusts the position of the seal (18) between the sealing position at which the seal (18) hermetically contacts the end plate (23) of the first scroll (21) and the leakage position at which the seal (18) is separated from the end plate (23) of the first scroll (21), thereby moving the first scroll (21) toward the second scroll (22) along the axial direction. If the scrolls (21, 22) are always kept at the compression position, the compressor is operated at 100% capacity. Further, if the scrolls (21, 22) are intermittently shifted to the non-compression position, the compressor is operated at a capacity less than 100%.

The position of the first scroll (21) is changed between the compression position and the non-compression position by merely adjusting the position of the seal (18). Therefore, different from a conventional technique of changing the pressure of the whole gas in a chamber (back pressure space) between high and low to bring the first scroll (21) and the second scroll (22) into press contact with each other, the position of the seal (18), which is a relatively small piece, is changed with use of a small amount of gas. Therefore, the occurrence of noise is reduced.

According to the first and second aspects of the present invention, if the compression mechanism (20) is adapted to suck liquid refrigerant or oil, the wraps (24, 26) of the scrolls (21, 22) may be situated at the non-compression position to avoid liquid compression. Thus, the reliability of the compressor improves.

According to the third aspect of the present invention, the position of the stationary scroll (21) or the moving scroll (22) is adjusted for easy control the capacity of the compressor. Further, the occurrence of noise is reduced.

According to the fourth aspect of the present invention, the high or medium pressure gas in the compressor chamber (27) is introduced into the back pressure space (S3) via the back pressure introduction path (23*a* or 25*a*). Therefore, the first scroll (21) and the second scroll (22) are surely kept in press contact with each other. This effect is easily achieved only by forming the back pressure introduction path (25*a*) in the end plate (23) of the first scroll (21) or the end plate (25) of the second scroll (22).

According to the fifth aspect of the present invention, the support recess (16*a* or 17*a*) is formed in the support (16 or 17) and the pressure in the support recess (16*a* or 17*a*) is switched between high and low such that the seal (18) is pressed against or separated from the end plate (23 or 25) of the first scroll (21) or the second scroll (22). By so doing, the position of the seal (18) is changed between the compression position at which the scrolls (21, 22) are brought into press contact with each other and the non-compression position at which the scrolls (21, 22) are separated from each other. In this case, as compared with a conventional compressor in which the entire capacity of a chamber (back pressure space) is used for the position control of the first and second scrolls, the capacity of the support recess (16*a* or 17*a*) used for the position control is small. Therefore, when the pressure is switched from high to low, the amount of the high pressure gas flowing into the low pressure region is small. Therefore, the occurrence of noise is reduced with reliability.

According to the sixth aspect of the present invention, the pressure in the support recess (16*a* or 17*a*) is changed between high and low by merely providing the high pressure communication path (41) with the restrictor (44) and the low pressure communication path (42) with the on-off valve (43). Thus, the structure of the compressor is simplified.

DETAILED DESCRIPTION OF THE INVENTION

Hereinafter, a detailed explanation of embodiments of the present invention will be provided.

First Embodiment

Figure 1:
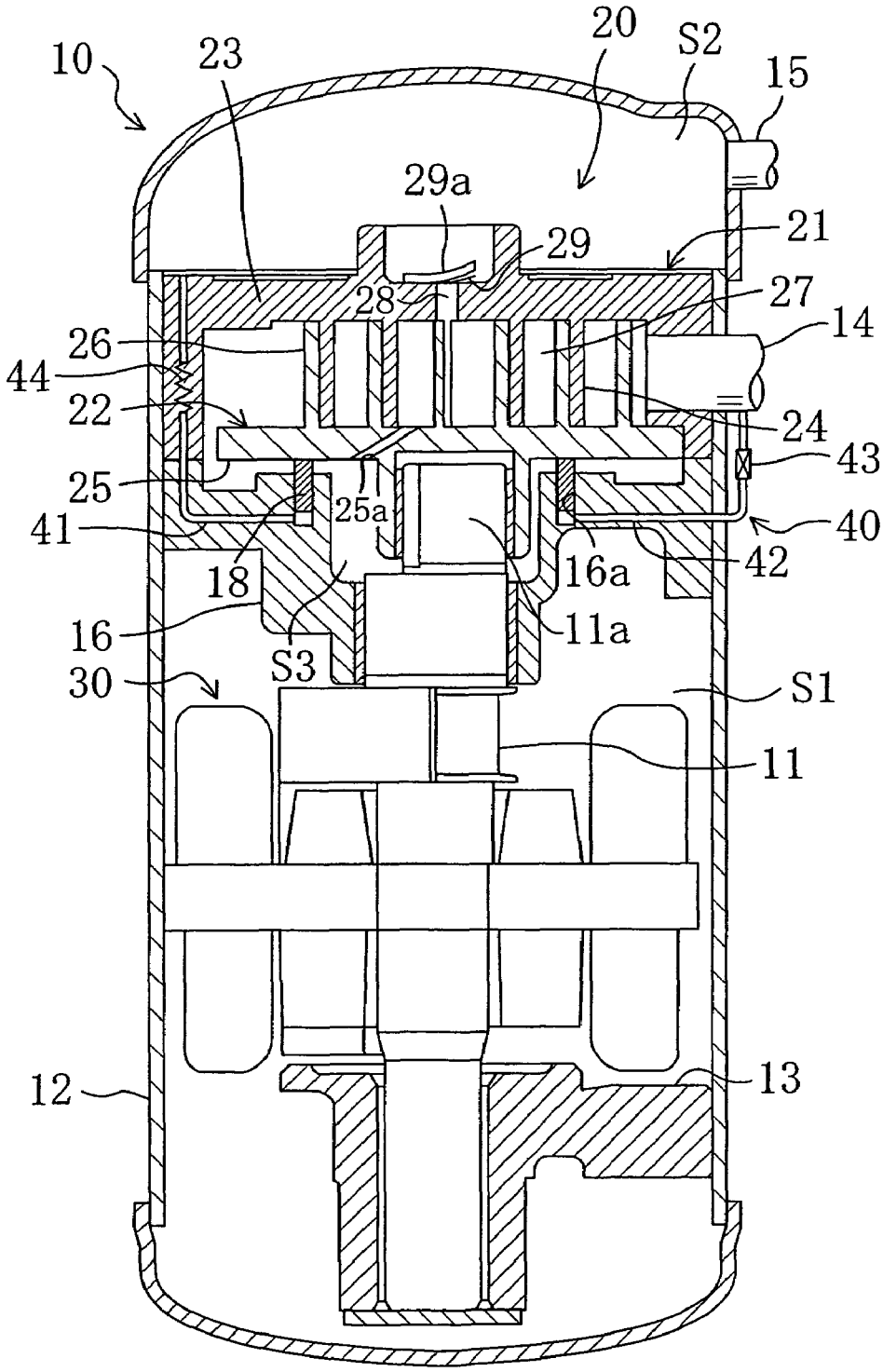
FIG. 1 is a vertical section illustrating a scroll compressor according to a first embodiment at a compression position.
Figure 2:
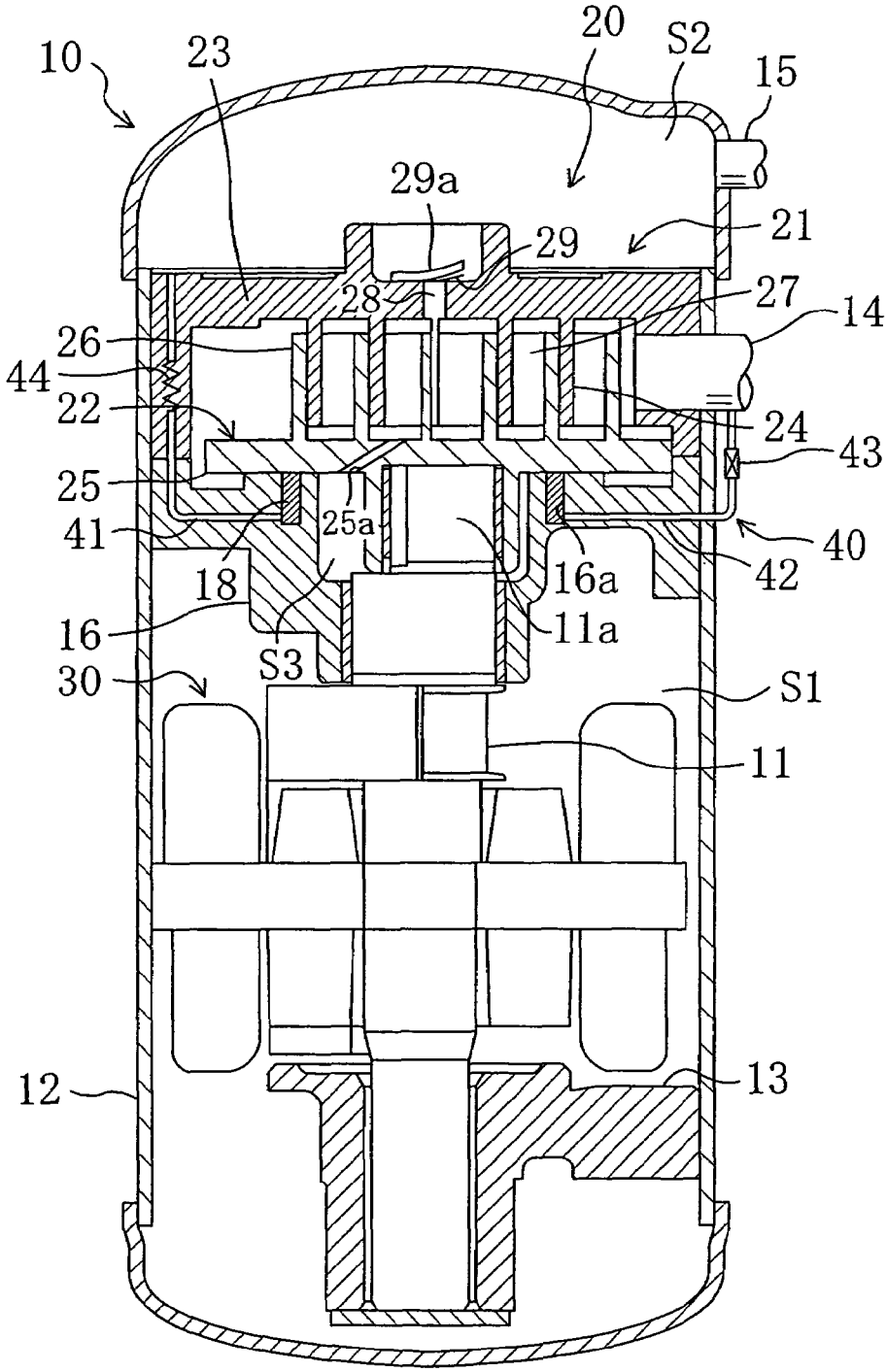
FIG. 2 is a vertical section illustrating the scroll compressor according to the first embodiment at a non-compression position.
Figure 3A:
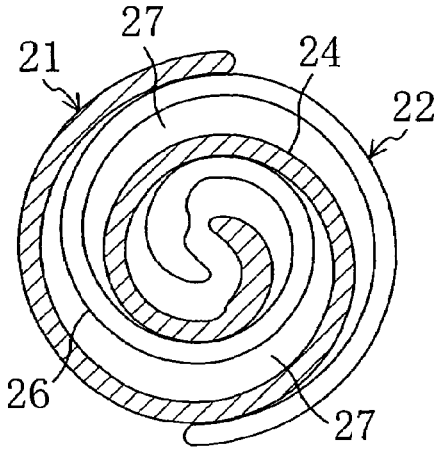
FIGS. 3A to 3D are horizontal sections illustrating how a compressor mechanism works.
Figure 3D:
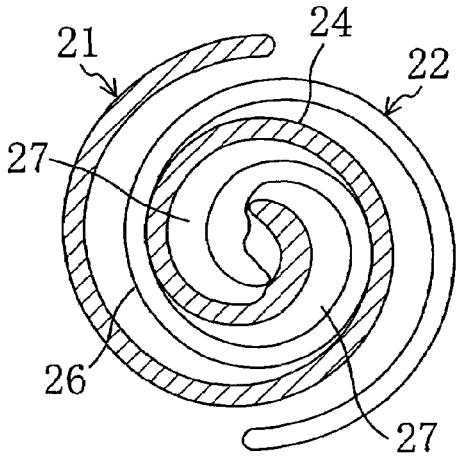
Figure 3B:
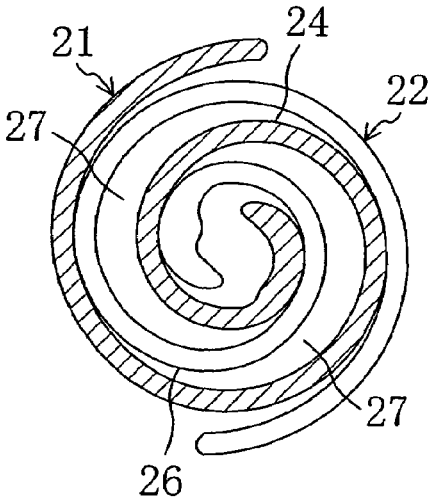
Figure 3C:
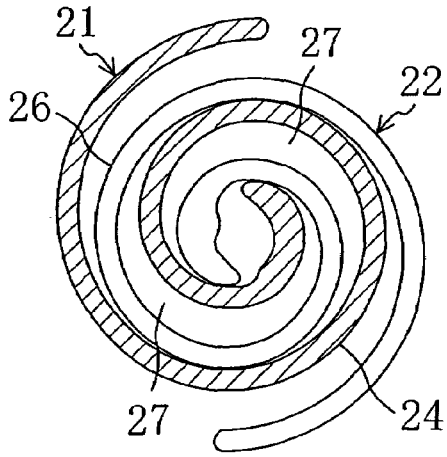

FIGS. 1 and 2 are vertical sections illustrating a scroll compressor (10) of a first embodiment and FIGS. 3A to 3D are horizontal sections illustrating how a compressor mechanism (20) works. As shown in FIGS. 1 and 2, the scroll compressor (10) of the first embodiment includes a compressor mechanism (20), a motor (30) and a drive shaft (11). For example, the scroll compressor (10) is incorporated in a refrigerant circuit such as an air conditioner to compress refrigerant gas.

The motor (30) is connected to the compressor mechanism (20) via the drive shaft (11). The compressor mechanism (20) and the motor (30) are hermetically disposed in a cylindrical casing (12). The scroll compressor (10) is vertically oriented. The compressor mechanism (20) is positioned at an upper part of the inside space of the casing (12) and a bottom bearing (13) is fixed at a lower part of the inside space of the casing (12). The motor (30) is arranged between the compressor mechanism (20) and the bottom bearing (13).

The casing (12) further includes a suction pipe (14) communicating with the compressor mechanism (20) to pass the refrigerant. A discharge pipe (15) is provided at the head part of the casing (12) above the compressor mechanism (20) to pass the compressed refrigerant. In the casing (12), space is provided above and below the compressor mechanism (20). Both of the lower space (Si) and the upper space (S2) are under high pressure. The refrigerant introduced into the casing (12) through the suction pipe (14) is sucked into the compressor mechanism (20), compressed in the compressor mechanism (20), discharged into the high pressure space (S2) and then flown out of the discharge pipe (15).

The compressor mechanism (20) includes a stationary scroll (21) as a first scroll, a moving scroll (22) as a second scroll and a frame (16). The frame (16) is fixed to the casing (12) and functions as a support for supporting the moving scroll (22) from below.

The stationary scroll (21) has an end plate (23) and a spiral wrap (24) formed on the end plate (23). The moving scroll (22) has an end plate (25) and a spiral wrap (26) formed on the end plate (25). The stationary scroll (21) and the moving scroll (22) are arranged such that their wraps (24, 26) are engaged with each other. With the wraps (24, 26) of the scrolls (21, 22) engaged as described above, a compressor chamber (27) as a working chamber is defined by the wraps (24, 26) and the end plates (23, 25). A suction port (not shown) is formed at the outer circumference of the stationary scroll (21) to suck low pressure refrigerant into the compressor chamber (27) and a discharge port (28) is formed at the center of the stationary scroll (21) to discharge the refrigerant compressed in the compressor chamber (27). The stationary scroll (21) is further provided with a discharge valve (reed valve) (29) for opening/closing the discharge valve (28) and a valve guard (29*a*) for determining the movable range of the discharge valve (29).

The stationary scroll (21) is fixed to the frame (16) and the moving scroll (22) is mounted on the frame (16) via an Oldham ring (not shown). An eccentric part (11*a*) which is formed on the drive shaft (11) is connected to the rear side (bottom side) of the moving scroll (22). When the drive shaft (11) is rotated, the moving scroll (22) revolves in an orbit whose radius is an eccentricity of the eccentric part (11*a*) from the rotation center of the drive shaft (11). The Oldham ring is adapted to hinder the moving scroll (22) from spinning by itself. Therefore, the moving scroll (22) revolves without spinning by itself as the drive shaft (11) rotates. As a result, the capacity of the compressor chamber (27) formed between the wraps (24, 26) of the scrolls (21, 22) is varied continuously as shown in FIGS. 3A to 3D.

The moving scroll (22) is slidably connected to the drive shaft (11) such that the position thereof is adjusted up and down along the axial direction. The positional relationship between the moving scroll (22) and the stationary scroll (21) is changed between a compression position (see FIG. 1) at which the wraps (24, 26) of the scrolls (21, 22) are hermetically engaged to define a compressor chamber (27) therebetween and a non-compression position (see FIG. 2) at which the wraps (24, 26) are not hermetically engaged and the compressor chamber (27) is not formed.

A seal ring (seal) (18) is provided between the frame (16) and the moving scroll (22). The seal ring (18) is disposed in a support recess (16*a*) formed in the top surface of the frame (16). The support recess (16*a*) and the seal ring (18) are annular, respectively. Further, back pressure space (S3) is defined inside the seal ring (18) between the frame (16) and the moving scroll (22).

The end plate (25) of the moving scroll (22) is provided with a back pressure introduction path (25*a*). The back pressure space (S3) and the center part (high pressure region) of the compressor chamber (53) communicate with each other via the back pressure introduction path (25*a*). Therefore, when the compressor (10) is operated, the pressure in the back pressure space (S3) becomes the same as the pressure in the center part of the compressor chamber (27) (high pressure: HP). Accordingly, the high pressure of the refrigerant in the back pressure space (S3) acts on the bottom side of the moving scroll (22) such that the moving scroll (22) is pressed upward against the stationary scroll (21). As a result, the moving scroll (22) and the stationary scroll (21) in the engaged state are pressed against each other.

The support (16) supports the seal ring (18) in the support recess (16*a*) such that the seal ring (18) moves toward and away from the moving scroll (22) (up and down movement). In the first embodiment, a position adjustment means (40) for adjusting the position of the moving scroll (22) along the axial direction of the compressor mechanism (20) with use of the seal ring (18). The position adjustment means (40) includes a high pressure communication path (41) for making the rear end part (bottom end part) of the support recess (16*a*) communicate with the high pressure space (high pressure region) (S2), a low pressure communication path (42) for making the rear end part (bottom end part) of the support recess (16*a*) communicate with the suction pipe (low pressure region) (14) and a switching mechanism (43) for switching the gas pressure in the support recess (16*a*) between high and low.

The high pressure communication path (41) is provided with a restrictor (44). Further, the low pressure communication path (42) is provided with an electromagnetic valve (on-off valve) (43) for switching the state of the low pressure communication path (42) between "open" and "closed".

When the electromagnetic valve (43) is turned off during the operation of the compressor (10), the low pressure communication path (42) is closed and the support recess (16*a*) communicates with the high pressure space (S2). Accordingly, the seal ring (18) is pressed upward from the support recess (16*a*) of the frame (16) and pressed against the end plate (25) of the moving scroll (22). As a result, high pressure gas is introduced from the compressor chamber (27) to the space inside the seal ring (18). Thus, the back pressure space (S3) is high-pressured. The high pressure acts on the bottom side of the end plate (25) to press the moving scroll (22) against the stationary scroll (21) to be in the compression position shown in FIG. 1.

Conversely, when the electromagnetic valve (43) is turned on, the support recess (16*a*) communicates with the suction pipe (14), whereby the high pressure gas in the support recess (16*a*) flows into the suction pipe (14). Accordingly, the seal ring (18) is not pressed against the end plate (25) of the moving scroll (22), thereby generating a gap between the end plate (25) and the seal ring (18) through which the refrigerant leaks. Further, a gap is also formed between the end plates (23, 25) and the wraps (24, 26) of the stationary and moving scrolls (21) and (22), thereby leaking the refrigerant. In this state, the moving scroll moves down to the position shown in FIG. 2, whereby the scrolls (21, 22) are situated at the non-compression position at which the refrigerant is not compressed. In order to move the moving scroll (22) down to the non-compression position with reliability, a biasing means such as a spring may be provided.

Operation

Subsequently, an explanation of how the scroll compressor (10) works will be provided.

First, in order to operate the compressor at 100% capacity, the electromagnetic valve (43) is turned off such that the support recess (16*a*) does not communicate with the suction pipe (14). By so doing, the pressure in the support recess (16*a*) is raised and the seal ring (18) is pressed against the end plate (25) of the moving scroll (22). As a result, the pressure in the back pressure space (S3) inside the seal ring (18) is raised, thereby keeping the moving scroll (22) pressed against the stationary scroll (21). As a result, the moving scroll (22) revolves about the stationary scroll (21) without spinning by itself while the wraps (24, 26) of the stationary scroll (21) and the moving scroll (22) substantially do not form any gap that leaks the refrigerant. Then, the refrigerant flowing from the suction pipe (14) is sucked into the compressor chamber (27) of the compressor mechanism (20) as the capacity of the chamber increases. As the moving scroll (22) revolves, the compressor chamber (27) decreases in capacity as it moves to the center, thereby compressing the sucked refrigerant (see FIGS. 3A to 3D).

The refrigerant is compressed as the capacity of the compressor chamber (27) varies. Then, the high-pressured refrigerant is discharged to the high pressure space (S2) in the casing (12) through a discharge port (28) formed almost in the middle of the stationary scroll (21). The discharged refrigerant is sent to a refrigerant circuit through the discharge pipe (15), subjected to condensation, expansion and evaporation in the refrigerant circuit and then sucked again by the suction pipe (14) for compression.

Figure 4A:
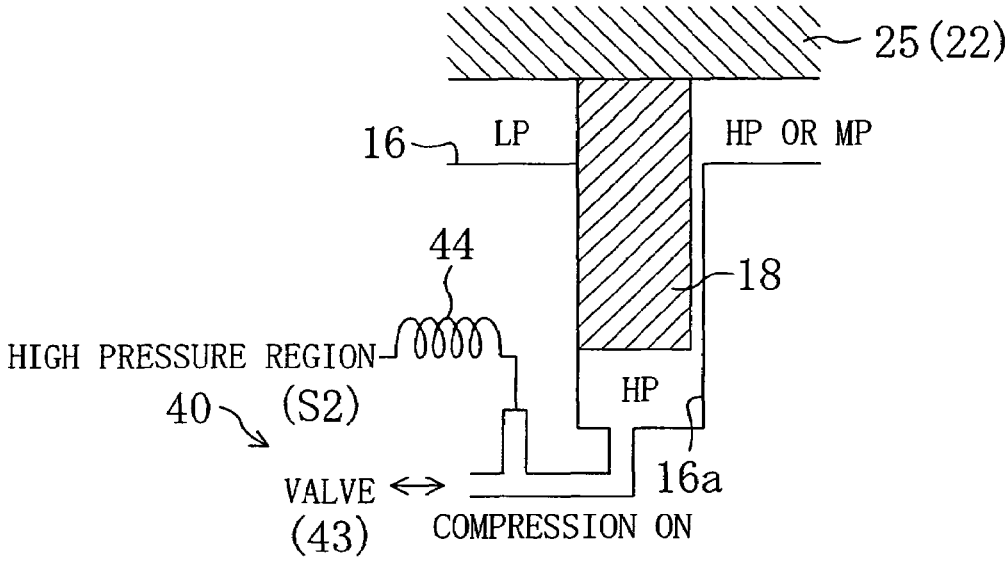
FIGS. 4A and 4B are sections illustrating how a seal ring works.

The center part of the compression chamber (27) communicates with the back pressure space (S3) via the back pressure introduction path (25*a*). Therefore, during the operation, the pressure in the back pressure space (S3) inside the seal ring (18) is high (HP) and the high pressure acts on the end plate (25) of the moving scroll (22) from below. As a result, in the 100% capacity operation, the moving scroll (22) is kept pressed against the stationary scroll (21) (FIG. 4A).

Figure 4B:
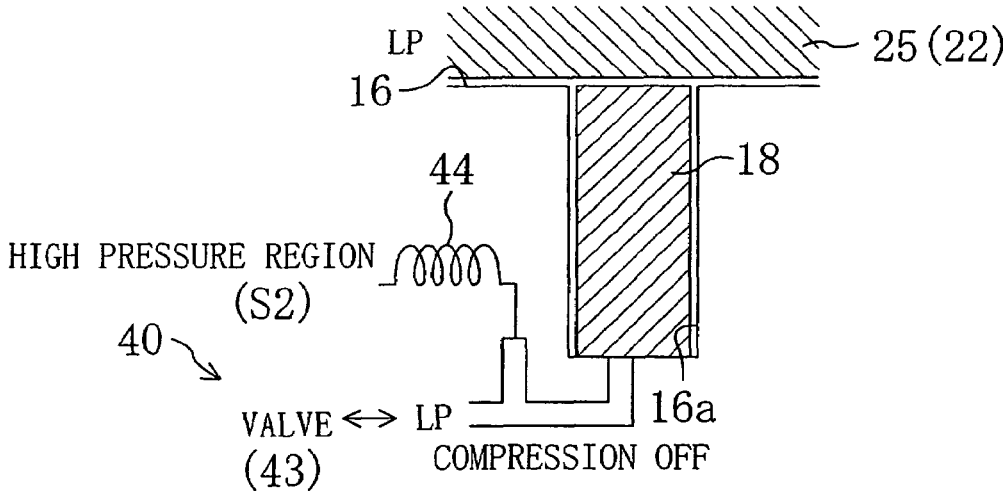

In order to operate the compressor at a capacity less than 100%, the electromagnetic valve (43) is turned on while the motor (30) is working such that the seal ring (18) descends into the support recess (16*a*). After the seal ring (18) has moved down, the high pressure refrigerant in the back pressure space (S3) flows into the surrounding low pressure region through the gap between the seal ring (18) and the end plate (25). Thus, the pressure in the back pressure space (S3) is reduced. At this time, space at the periphery of the compressor chamber (27) (low pressure region) and space at the center of the compressor chamber (27) communicate with each other and the center space and the back pressure space (S3) communicate with each other. Therefore, the pressures in the spaces are uniformed to be low (LP). As a result, the force pressing the moving scroll (22) against the stationary scroll (21) disappears and the moving scroll (22) moves down under its own weight (or the biasing force of a spring). As a result, the refrigerant is not compressed (FIG. 4B).

Therefore, during the operation at a capacity less than 100%, the expansion and contraction of the polymer actuator (40) is repeated at the ratio of 8:2, for example, to control the capacity at 80%. If the ratio is suitably changed, the capacity is also changed as required.

If the compressor mechanism (20) of the first embodiment is adapted to suck liquid refrigerant or oil, the wraps (24, 26) of the scrolls (21, 22) are situated at the non-compression position to avoid liquid compression. Accordingly, the occurrence of dreadful noise and oscillation caused by the liquid compression is prevented and the compressor (10) is protected from damage.

Effect of the First Embodiment

According to the first embodiment, the support recess (16*a*) for housing the seal ring (18) is usually filled with high pressure gas. For the capacity control, the high pressure gas flows into the low pressure region to make the seal ring (18) ineffective. Therefore, the operation capacity of the compressor (10) is adjusted by easy control. Further, the structure of the compressor (10) is not complicated because no complex mechanism is used for the positional adjustment of the moving scroll (22).

As compared with a conventional system using an electromagnetic valve which makes big noise when all the high pressure gas in a large chamber such as the back pressure space is drawn to the low pressure region, such a noise is less likely to occur in the first embodiment because the capacity control is achieved by merely switching the pressure for moving the seal ring (18) up or down.

Further, in addition to the pressing force by the polymer actuator (40), the pressure caused by the back pressure space (S3) is also used to keep the scrolls (21, 22) at the compression position. Therefore, there is no possibility of lack of the force pressing the scrolls (21, 22).

Second Embodiment

Figure 5:
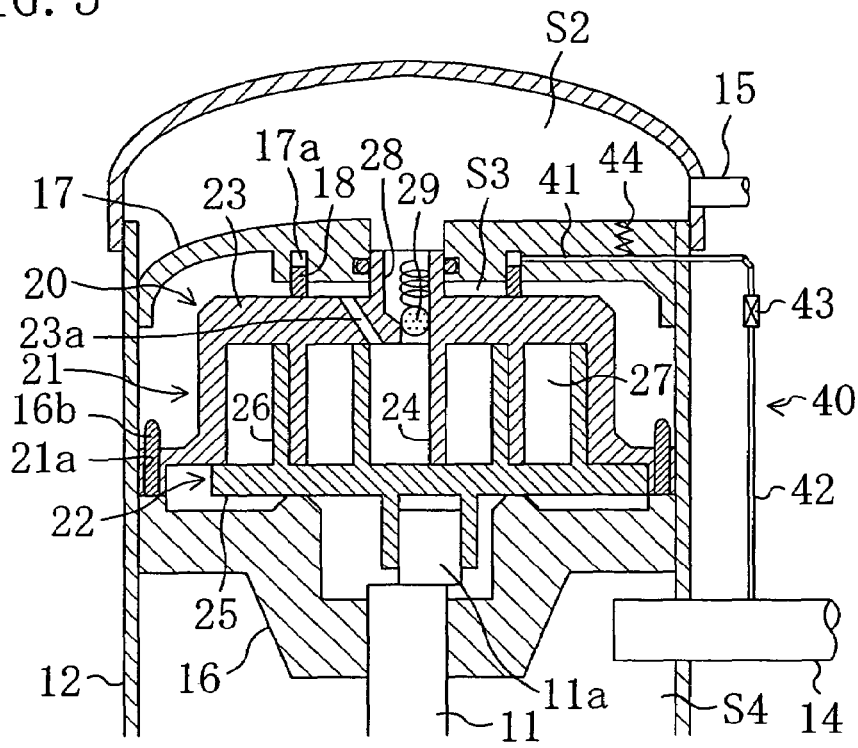
FIG. 5 is a partial vertical section illustrating a scroll compressor according to a second embodiment at a compression position.
Figure 6:
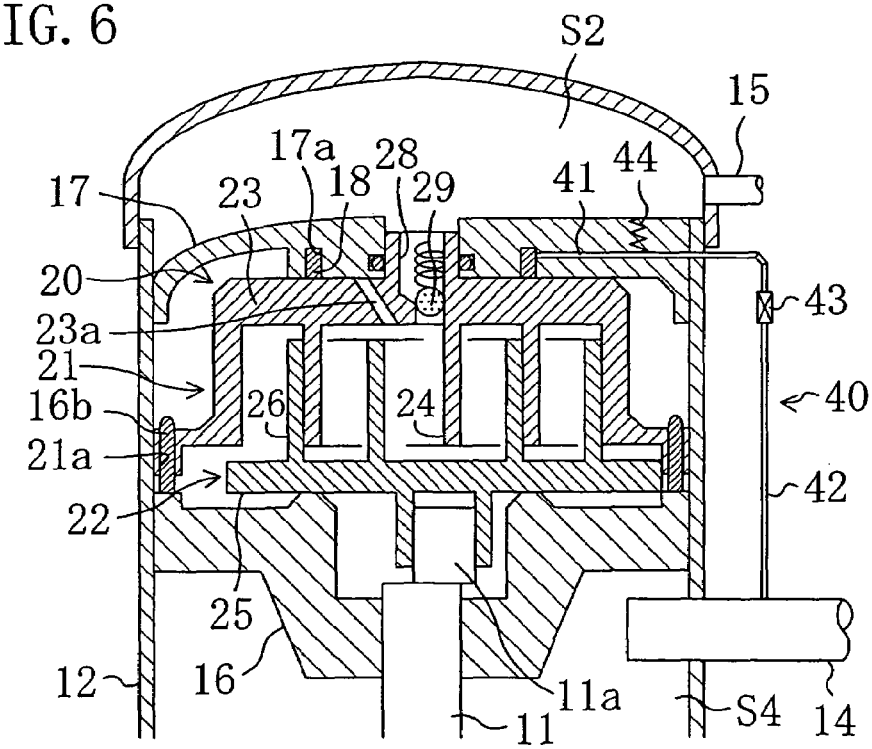
FIG. 6 is a partial vertical section illustrating the scroll compressor according to the second embodiment at a non-compression position.

An explanation of a second embodiment of the present invention will be provided with reference to FIGS. 5 and 6.

In the present embodiment, the position of the stationary scroll (21) is adjusted along the axial direction in the opposite manner from the first embodiment.

Referring to the drawings, a joint hole (21*a*) is formed in the periphery of the stationary scroll (21) such that it engages with a pin (16*b*) of a frame (16) fixed to a casing (12). The stationary scroll (21) is allowed to move up and down along the axial direction of a drive shaft (11) by the engagement between the pin (16*b*) and the joint hole (21*a*). A biasing means (not shown) such as a spring is provided near the pin (16*b*) to apply upward biasing force to the stationary scroll (21).

A discharge port (28) is formed in the center of the stationary scroll (21) and a discharge valve (ball valve) (29) is arranged therein.

The casing (12) includes a partition plate (17) which is fixed thereto above the compressor mechanism (20). Space above the partition plate (17) is defined as high pressure space (S2) above and space below the partition plate (17) is defined as low pressure space (S4). Refrigerant sucked into the casing (12) through a suction pipe (14) is transferred from the low pressure space (S4) to a compression chamber (27) through a suction port (not shown) of the compression mechanism (20). The refrigerant is compressed as the capacity of the compressor chamber (27) is varied, and then discharged out of a discharge pipe (15) through the high pressure space (S2).

The partition plate (17) functions as a support for supporting the stationary scroll (21) from above. The partition plate (17) includes an annular support recess (17*a*) and an annular seal ring (18) is disposed in the support recess (17*a*). In an end plate (23) of the stationary scroll (21), a back pressure introduction path (23*a*) is formed such that a back pressure space (S3) communicates with the center part of the compressor chamber (27).

A rear end part (top end part) of the support recess (17*a*) communicates with the high pressure region (high pressure space (S2)) via a high pressure communication path (41) and a restrictor (44). The high pressure communication path (41) further communicates with the low pressure region (suction pipe (14)) via a low pressure communication path (42) having an electromagnetic valve (an open/close mechanism). These components provide a position adjustment means (40) in the same manner as in the first embodiment.

In order to drive the compressor of the second embodiment at 100% capacity, the electromagnetic valve (43) is closed and high pressure gas is introduced to the support recess (17*a*). Accordingly, the seal ring (18) is pressed against the end plate (23) of the stationary scroll (21) to introduce high pressure gas from the compressor chamber (27) to the back pressure space (S3). Then, the stationary scroll (21) and the moving scroll (22) enter the state where no gap is formed therebetween (the compression position) and the moving scroll (22) revolves to compress the refrigerant.

In order to control the capacity, on the other hand, the electromagnetic valve (43) is intermittently opened. Accordingly, the high pressure gas in the support recess (17*a*) flows into the suction pipe (14) via the low pressure communication path (42), generating a gap that leaks the refrigerant between the end plate (23) of the stationary scroll (21) and the seal ring (18). As a result, the stationary scroll (21) is no longer pressed against the moving scroll (22) due to the biasing force of the biasing means provided near the pin (16*b*) and the space between the scrolls (21, 22) communicates with the surrounding space to reduce the pressure. Thus, the compression of the refrigerant does not occur.

In the same manner as in the first embodiment, the capacity of the compressor (10) is controlled by merely opening the electromagnetic valve (43) intermittently. The present embodiment is the same as the first embodiment in that the operation capacity of the compressor (10) is adjusted by a simple step of moving the seal ring (18) up or down by introducing the high pressure gas into the support recess (17*a*) or discharging the gas to the suction pipe (14), and that the structure of the compressor (10) is not complicated because the mechanism for adjusting the position of the moving scroll (22) is not intricate.

Further, as described in the first embodiment, the occurrence of noise is prevented because there is no need of instantaneously discharging all the high pressure gas out of a large chamber such as the back pressure space (S3) into the low pressure region. Moreover, in addition to the pressing force by the polymer actuator (40), the pressure caused by the back pressure space (S3) is also used to keep the scrolls (21, 22) at the compression position. Therefore, there is no possibility of lack of the force pressing the scrolls (21, 22).

In the second embodiment, the seal ring (18) is pressed against the end plate (23) of the stationary scroll (21) which does not revolve. Therefore, the seal ring (18) is less likely to be worn as compared with the case where the seal ring (18) is pressed against the end plate (25) of the moving scroll (22).

Other Embodiments

The above-described embodiments of the present invention may be modified as follows.

For example, in the above-described embodiments, the high pressure (HP) center part of the compressor chamber (27) communicates with the back pressure space (S3) via the back pressure introduction path (25*a*). However, the back pressure introduction path (25*a*) may be formed such that the back pressure space (S3) communicates with a middle part of the compression chamber (27) between the center part and the periphery part thereof applied with medium pressure (MP). That is, the back pressure introduction path (25*a*) may be formed in any way as long as it makes possible to keep the moving scroll (22) and the stationary scroll (21) in a sealed state (at the compression position).

In the above-described embodiments, the back pressure introduction path (23*a* or 25*a*) is formed in the end plate (23) of the stationary scroll (21) or the end plate (25) of the moving scroll (22) such that the high pressure (HP) or medium pressure (MP) refrigerant is introduced to the back pressure space (S3). However, other means than the back pressure introduction paths (23*a*, 25*a*) may be used to introduce the high pressure refrigerant to the back pressure space (S3). For example, in a high pressure dome-shaped compressor in which the whole space in the casing (12) is applied with high pressure, high pressure lubricating oil which is trapped in the casing (12) and supplied to the moving scroll (22) and the bearing of the drive shaft (11) is also supplied to the back pressure space. Therefore, the pressure of the lubricating oil may be used together with the pressure of the refrigerant.

In the above-described embodiments, the electromagnetic valve is used to switch the gas pressure between high and low to move the seal ring (18) up and down. However, the seal ring (18) may be driven by a mechanical means. Further, in order to switch the pressure in the support recess (16*a* or 17*a*) between high and low, a two-way switching valve (on-off valve) used in the above-described embodiments may be replaced with a three-way switching valve for switching the communication between the high pressure path, low pressure path and support recess (16*a* or 17*a*).

In summary, according to the present invention, the structure of the compressor may suitably be modified as long as the pressure of the back pressure space (S3) is adjusted by the seal ring (seal) such that the scrolls (21, 22) are situated at the compression position or the non-compression position.

INDUSTRIAL APPLICABILITY

As described above, the present invention is useful for a scroll compressor in which the position of one of a first scroll (stationary scroll) and a second scroll (moving scroll) is adjusted along the axial direction.

The invention claimed is:

1. A scroll compressor comprising:

a compressor mechanism including a first scroll having an end plate and a spiral wrap formed thereon and a second scroll having an end plate and a spiral wrap formed thereon and engaging with the first scroll;

a support for supporting the second scroll;

a seal arranged between the support and the second scroll; and a position adjustment device for changing a position of the second scroll along an axial direction of the compressor mechanism, the seal hermetically contacting the end plate of the second scroll such that a back pressure space for bringing the first scroll and the second scroll into contact with each other is defined inside the seal with the first and second scrolls being engaged, and the position adjustment device being configured to change a position of the seal between a sealing position at which the seal hermetically contacts the end plate of the second scroll and a leakage position at which the seal is separated from the end plate of the second scroll to place the second scroll in a non-compression position.

2. The scroll compressor of claim 1, wherein the first scroll is a stationary scroll prohibited from revolving, and the second scroll is a moving scroll that is movable with respect to the first scroll.

3. The scroll compressor of claim 1, wherein the end plate of the second scroll is provided with a back pressure introduction path for making the back pressure space communicate with a portion of a compressor chamber defined between the first scroll and the second scroll, the portion being more inside than a periphery of the compressor chamber.

4. A scroll compressor comprising:

a compressor mechanism including a first scroll having an end plate and a spiral wrap formed thereon and a second scroll having an end plate and a spiral wrap formed thereon and engaging with the first scroll;

a support for supporting the second scroll;

a seal arranged between the support and the second scroll; and a position adjustment device for changing a position of the second scroll along an axial direction of the compressor mechanism, the seal hermetically contacting the end plate of the second scroll such that a back pressure space for bringing the first scroll and the second scroll into contact with each other is defined inside the seal with the first and second scrolls being engaged, the position adjustment device being configured to change a position of the seal between a sealing position at which the seal hermetically contacts the end plate of the second scroll and a leakage position at which the seal is separated from the end plate of the second scroll, the support including a support recess for supporting the seal such that the seal moves toward or away from the support, and the position adjustment device including a high pressure communication path for making a rear end part of the support recess communicate with a high pressure region, a low pressure communication path for making the rear end part of the support recess communicate with a low pressure region and a switching mechanism for switching the communication between the support recess and the low pressure communication path.

5. The scroll compressor of claim 4, wherein the high pressure communication path has a restrictor, and the low pressure communication path has an on-off valve as the switching mechanism.

* * * * *